US008534720B2

(12) United States Patent
Meyer et al.

(10) Patent No.: US 8,534,720 B2
(45) Date of Patent: Sep. 17, 2013

(54) FRONT HOOD SAFETY CLOSURE SYSTEM HAVING A SEPARATE CATCH-HOOK CONTROL

(75) Inventors: Dieter Meyer, Wolfsburg (DE); Alexander Schaaf, Bokensdorf (DE); Florian Zysk, Berlin (DE); Michael Drescher, Olbernhau (DE); Bernd Krauter, Ingolstadt (DE)

(73) Assignees: Volkswagen AG, Wolfsburg (DE); Audi AG, Ingolstadt (DE)

( * ) Notice: Subject to any disclaimer, the term of this patent is extended or adjusted under 35 U.S.C. 154(b) by 316 days.

(21) Appl. No.: 12/863,544

(22) PCT Filed: Nov. 22, 2008

(86) PCT No.: PCT/EP2008/009909
§ 371 (c)(1),
(2), (4) Date: Oct. 12, 2010

(87) PCT Pub. No.: WO2009/089865
PCT Pub. Date: Jul. 23, 2009

(65) Prior Publication Data

US 2011/0025077 A1 Feb. 3, 2011

(30) Foreign Application Priority Data

Jan. 19, 2008 (DE) ..... 10 2008 005 273

(51) Int. Cl.
*E05C 3/06* (2006.01)
*E05C 3/16* (2006.01)

(52) U.S. Cl.
USPC ..... 292/216; 292/DIG. 14

(58) Field of Classification Search
USPC ..... 292/216, DIG. 14
See application file for complete search history.

(56) References Cited

U.S. PATENT DOCUMENTS 2,924,473 A * 2/1960 Krause ..... 292/11
3,010,749 A * 11/1961 Brissette et al. ..... 292/27

(Continued)

FOREIGN PATENT DOCUMENTS

DE 90 06 995 9/1990
DE 42 05 309 8/1993

(Continued)

OTHER PUBLICATIONS

International Search Report and Written Opinion, PCT/EP2008/002146, dated Dec. 29, 2009.

(Continued)

*Primary Examiner* — Carlos Lugo
(74) *Attorney, Agent, or Firm* — Kenyon & Kenyon LLP

(57) ABSTRACT

A front hood safety closure system for motor vehicles includes a rotary latch disposed to swivel about an axis, a catch hook, a striker, as well as a retaining pawl disposed to swivel about an axis, in the closed position of the front hood, the rotary latch being connected to the striker located on the front hood in that the rotary latch receives the middle limb of the striker within a fork-shaped recess adapted to the shape of the striker, and when the locking of the front hood is released, the striker being connected to the catch hook performing a safety function upon release of the retention by the rotary latch, both the rotary latch and the retaining pawl assigned a stop. The catch hook is swivelable, independently of the rotary latch, about the catch hook axis, the catch hook axis being coincident with the rotary latch axis.

8 Claims, 1 Drawing Sheet

(56) References Cited

U.S. PATENT DOCUMENTS

| | | | | | |
|---|---|---|---|---|---|
| 3,236,551 | A | * | 2/1966 | Nash | 292/11 |
| 3,378,289 | A | * | 4/1968 | Beckman et al. | 292/31 |
| 3,905,624 | A | * | 9/1975 | Fujita | 292/11 |
| 4,875,724 | A | * | 10/1989 | Gruber | 292/216 |
| 4,917,420 | A | * | 4/1990 | Rogers, Jr. | 292/198 |
| 4,936,611 | A | * | 6/1990 | Palvolgyi | 292/28 |
| 5,348,355 | A | * | 9/1994 | Oyha | 292/11 |
| 5,445,421 | A | * | 8/1995 | Ferrara | 292/216 |
| 5,618,069 | A | * | 4/1997 | Konchan et al. | 292/216 |
| 5,738,393 | A | * | 4/1998 | Chao | 292/216 |
| 5,853,060 | A | * | 12/1998 | Chao et al. | 180/69.2 |
| 5,908,165 | A | | 6/1999 | Guschall et al. | |
| 6,070,733 | A | | 6/2000 | Osing | |
| 6,361,091 | B1 | * | 3/2002 | Weschler | 292/336.3 |
| 6,422,493 | B1 | | 7/2002 | Simon et al. | |
| 6,422,616 | B1 | * | 7/2002 | Wortmann et al. | 292/216 |
| 6,547,291 | B1 | * | 4/2003 | Schwaiger | 292/216 |
| 6,974,097 | B2 | | 12/2005 | Simon et al. | |
| 7,261,337 | B2 | * | 8/2007 | Nakagome et al. | 292/216 |
| 7,325,757 | B2 | | 2/2008 | Allen et al. | |
| 7,780,208 | B2 | | 8/2010 | Koppenhoehl et al. | |
| 8,267,336 | B2 | | 9/2012 | Goldmann et al. | |
| 2004/0089102 | A1 | | 5/2004 | Goldmann et al. | |
| 2005/0156442 | A1 | | 7/2005 | Koppenhoehl et al. | |

FOREIGN PATENT DOCUMENTS

| | | | | |
|---|---|---|---|---|
| DE | 42 22 379 | | | 1/1994 |
| DE | 42 25 670 | | | 2/1994 |
| DE | 42 39 908 | | | 3/1994 |
| DE | 43 06 781 | | | 9/1994 |
| DE | 43 13 570 | | | 10/1994 |
| DE | 44 26 503 | | | 2/1996 |
| DE | 44 37 852 | | | 5/1996 |
| DE | 44 42 631 | | | 6/1996 |
| DE | 195 00 224 | | | 7/1996 |
| DE | 196 29 470 | | | 1/1998 |
| DE | 196 29 473 | | | 1/1998 |
| DE | 197 55 629 | | | 6/1999 |
| DE | 199 15 481 | | | 10/2000 |
| DE | 100 54 507 | | | 5/2002 |
| DE | 103 34 646 | | | 3/2005 |
| DE | 10 2004 045 821 | | | 3/2006 |
| DE | 10 2005 057 820 | | | 6/2007 |
| EP | 0 418 194 | | | 3/1991 |
| EP | 0 479 293 | | | 4/1992 |
| EP | 0 623 390 | | | 11/1994 |
| EP | 0 884 107 | | | 12/1998 |
| EP | 1 020 225 | | | 7/2000 |
| EP | 1 332 001 | | | 2/2007 |
| JP | 02229376 | A | * | 9/1990 |
| JP | 02232487 | A | * | 9/1990 |
| WO | WO 98/01276 | | | 1/1998 |
| WO | 02/34400 | | | 5/2002 |
| WO | WO 03/070529 | | | 8/2003 |

OTHER PUBLICATIONS

International Search Report and Written Opinion, PCT/EP2009/001699, dated Jul. 21, 2009.

Search Report, German Patent Application No. 10 2008 016 417.8, dated Oct. 8, 2008.

Search Report, German Patent Application No. 10 2009 009 873.9, dated Nov. 24, 2009.

International Search Report and Written Opinion, PCT/EP2008/009909, dated Apr. 3, 2009.

* cited by examiner

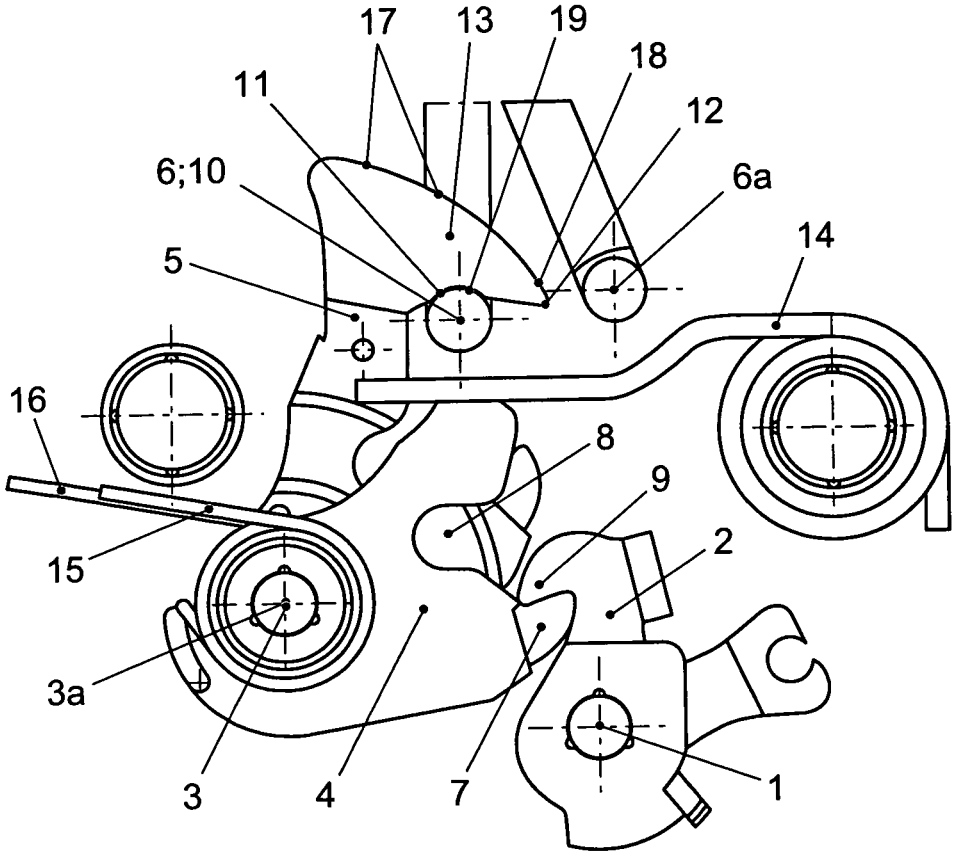
17
13
19
18
11
12
6;10
6a
14
5
16
8
9
2
15
3a
3
4
7
1

FRONT HOOD SAFETY CLOSURE SYSTEM HAVING A SEPARATE CATCH-HOOK CONTROL

FIELD OF THE INVENTION

The present invention relates to a front hood closure and safety system for motor vehicles.

BACKGROUND INFORMATION

It is well-known for the front hood of motor vehicles to be assigned a closure system which, besides its locking and release function, additionally ensures that upon release of the front hood, it initially can only be opened in limited fashion, so as to be able to be folded up into its end position only after being released by a safety catch hook.

Thus, for example, German Patent No. 42 39 908 describes a rotary-latch closure, particularly for locking the engine hood of motor vehicles, that is based on a retaining pawl, as well as a rotary latch operatively connected to the U-shaped striker. In the case of this rotary-latch closure, in the locked position of the engine hood, a u-shaped fork opening of the swivel-mounted rotary latch receives the middle limb of the striker in such a way that it is retained, and thus the engine hood is locked. If the intention is to release the engine hood, it is initiated by actuation of a retaining pawl, likewise swivel-mounted, by way of a cable pull, by release of an arresting action by stops assigned to the retaining pawl and the rotary latch. Starting out from the assumption that the rotary latch is under the force of an elastic spring element, the swivel motion resulting therefrom takes along the striker via its middle limb vertically upward until finally it is blocked in its vertical displacement in the end position of the rotary latch by a safety hook fixedly joined to a closure housing. During the vertical displacement of the striker and therefore of the middle limb, it is guided within a sliding channel, the inside width of the passage cross-section being completely covered by the hook end of the fixedly disposed safety hook. At the level of the catching limb of the u-shaped fork opening, the sliding channel, upon reaching the end position of the rotary latch, passes over into a centering shaft in such a way that the cross-section of the sliding channel is enlarged in wedge-shaped fashion in the upper closure area. In the case of this rotary-latch closure, in order to permit a complete opening of the engine hood after the striker has been blocked via its middle limb by the safety hook, the striker is joined to a lever plate which is swivel-mounted in a bearing plate. In this context, the side limbs of the striker are screw-fitted to the bottom side of the lever plate.

However, achieving the swiveling motion of the lever plate, which is necessary in order to swivel the middle limb of the striker out of the area of the hook end of the safety hook for the purpose of completely opening the engine hood—the striker being swiveled along about the same angle as the lever plate—is associated with a complex design of the lever plate which, in view of the components required, leads to relatively high costs, as well. In addition, a relatively great overall height results from this design.

Because the safety hook necessary in the case of this rotary-latch closure leads to an increase in the number of components and thus to a further increase in costs, and moreover, the complete covering of the inside width of the passage cross-section of the sliding channel by the hook end of the safety hook may lead to a functioning impairment, this rotary-latch closure—by which, to be sure, the intended effects are achieved—is also at the least still high-cost.

As described in PCT Published Patent Application No. WO 03/0705 29, it is also known to achieve increased pedestrian protection in the area of the lock assembly of vehicle hoods, in that the striker is secured in a manner allowing displacement on a flange plate disposed on the vehicle hood, and at the same time, is under the force of a helical spring; however, this formation and placement of the striker requires a relatively great overall height, as well, and assuming a rotary-latch closure made up of a rotary latch, a retaining pawl and an arresting lever, is not suitable for folding the vehicle hood up into its end position after the front hood has been released by execution of a swiveling motion of the striker.

Furthermore, the closure for hoods of motor vehicles described in German Published Patent Application No. 100 54 507, which operates on the basis of a rotary latch, a retaining pawl and a striker, likewise has a relatively great overall height. This results, inter alia, from the allocation of the striker to a counter closure part which is secured in position on the engine hood and is particularly compact. It includes a striker support in which the striker is axially displaceable, and upon its axial displacement, assumes a lower or upper position as a function of the locking or release. In addition, this closure is designed in such a way that it does not operate on the basis of a catch hook.

The safety latch for vehicle covers described in German Patent No. 43 13 570 is likewise based on a swivel-mounted rotary latch as well as a swivel-mounted retaining pawl in operative connection with the rotary latch, the rotary latch cooperating with a closure bracket bent in a U-shape. This safety latch fulfills its task with regard to the locking and release of the vehicle cover, but also with regard to safety because the rotary latch has a special design and, in order to fulfill its functions, requires further components that are operatively connected to it, so that this safety latch is high-cost, as well.

According to German Published Patent Application No. 10 2005 057 820, which likewise is based on a rotary latch and a catch hook, the rotary latch is extended on its side opposite its axis, thus forming the catch hook, in such a way that the middle limb of the striker is safely receivable by the hook of the catch hook—formed in extension of the rotary latch—at its lower side in the end position of the rotary latch in execution of its swiveling motion after the rotary latch has been released by the retaining pawl, with which is associated a vertical shift of the striker into a position in which, by way of its actuation, it is ready to release the securing of the front hood and thus to open it. In this context, the lower side of the hook of the catch hook is adapted substantially to the cross-section, and therefore the shape of the middle limb of the striker in that, for example, if the cross-section of the middle limb of the striker is circular, the lower side of the hook of the catch hook is curved inwardly.

This curvature is formed in such a way that, in the end position of the catch hook in execution of its swiveling motion after the rotary latch has been released, the middle limb of the striker, in accordance with its position taken in execution of the swiveling motion of the rotary latch, is at least partially covered by the inwardly curved lower side of the hook of the catch hook in the direction of the open side of the hook, so that a secure position of the middle limb and therefore of the striker is thereby ensured before, by its actuation, the front hood is folded up into its end position. In this context, given the partial covering of the middle limb of the striker in the direction of the open side of the hook by the curved lower side of the hook of the catch hook, the lower edge of the hook, possessing a radius, is intended to lie together with the axis of the middle limb of the striker approximately on a horizontally extending axis.

Thus, the safety latch described in German Published Patent Application No. 10 2005 057 820 describes a catch hook performing the safety function, it being disposed in a manner allowing it to swivel about an axis by integrating it into the rotary latch which is disposed in a manner allowing it to swivel about its axis, so that when the retention between the rotary latch and the retaining pawl, able to swivel about the axis, is released, the swiveling motion of the catch hook corresponds to the swiveling motion of the rotary latch.

SUMMARY

Example embodiments of the present invention provide a front hood safety closure system for motor vehicles without having to relinquish one of the safety features described in the documents cited above or one of the constructive advantages, and at the same time to avoid a possible sham closure.

Because the catch hook may indeed have the same axis of rotation as the rotary latch, but its rotary motions are independent of the rotary latch, and because it is provided with a return spring which brings the hook of the catch hook into position covering the path of motion of the striker and therefore ready for engagement, provided no force overcoming the spring energy is applied to the catch hook, the catch hook is also able to fulfill its safety function upon retention of the rotary latch without engagement of the striker and effectively prevent the front hood from unintentionally folding up after sham closures. The outer contour of the hook of the catch hook is chamfered or curved, such that the force resulting from the closing movement of the striker, upon contact with the catch hook, transmits to the catch hook a force component extending at right angles to the movement direction of the striker, which is sufficient to overcome the spring energy of the return spring to the extent that the striker clears the way for the catch hook in the closing movement. The axis of rotation of the catch hook, which, in order to keep the design simple, preferably agrees with the axis of rotation of the rotary latch, therefore is located outside of the line defined by the direction of motion of the striker. The spring energy of the return spring is preferably dimensioned such that, given a defined position of the axis of rotation and outer contour of the catch hook, by the mere resting of the front hood, thus of the striker, on the outer contour of the catch hook, it is already overcome by its dead weight.

The catch hook may be rotatable about the same axis of rotation as the rotary latch.

The effects intended may be attained not only when it is disposed at a front hood of a motor vehicle, but also everywhere that a safety closure system, made up of a rotary latch, a catch hook, a retaining pawl as well as a striker, is used, thus, for example, in the trunk lid of motor vehicles, as well.

According to an example embodiment of the present invention, a safety closure system for a front hood of a motor vehicle includes: a catch hook swivelable about a catch hook axis; a substantially U-shaped striker located on the front hood and having a middle limb; a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive. The rotary latch is adapted to receive the middle limb of the substantially U-shaped striker to operatively connect to the striker in a closed position of the front hood. The catch hook is adapted to operatively connect to the striker upon release of retention of the front hood by the rotary latch to perform a safety function. The catch hook is swivelable, independently of the rotary latch, about the catch hook axis, and the catch hook axis extends parallel to the rotary latch axis.

The rotary latch axis and the catch hook axis may coincide.

The catch hook may be operatively connected to a return spring.

An outer contour of a hook of the catch hook at a right angle to the axis catch hook axis may have a slope in a direction of an end of the hook.

An outer contour of a hook of the catch hook may be convexly curved.

The slope of the outer contour of the hook of the catch hook may increase at the end of the hook.

A lower side of a hook of the catch hook may be at least partially complementary to an outer contour of the middle limb of the striker so that the middle limb of the striker is accommodatable securely by the hook of the catch hook.

According to an example embodiment of the present invention, a safety closure system for a front hood of a motor vehicle, the front hood including a substantially U-shaped striker having a middle limb, includes: a catch hook swivelable about a catch hook axis; a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive. The rotary latch is adapted to receive the middle limb of the substantially U-shaped striker to operatively connect to the striker in a closed position of the front hood. The catch hook is adapted to operatively connect to the striker upon release of retention of the front hood by the rotary latch to perform a safety function. The catch hook is swivelable, independently of the rotary latch, about the catch hook axis, and the catch hook axis extends parallel to the rotary latch axis.

According to an example embodiment of the present invention, a motor vehicle includes: a front hood including a substantially U-shaped striker having a middle limb; and a safety closure for the front hood. The safety closure includes: a catch hook swivelable about a catch hook axis; a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive. The he rotary latch is adapted to receive the middle limb of the substantially U-shaped striker to operatively connect to the striker in a closed position of the front hood. The catch hook is adapted to operatively connect to the striker upon release of retention of the front hood by the rotary latch to perform a safety function. The catch hook is swivelable, independently of the rotary latch, about the catch hook axis, and the catch hook axis extends parallel to the rotary latch axis.

Example embodiments of the present invention are described below with reference to the appended drawing.

BRIEF DESCRIPTION OF THE DRAWING

FIG. 1 is a side view of a front hood safety closure system.

DETAILED DESCRIPTION

The front hood safety closure system according to FIG. 1 includes a retaining pawl 2 disposed in a manner allowing it to swivel about a first axis 1, a rotary latch 4 disposed in a manner allowing it to swivel about a second axis 3, a catch hook 5 able to swivel about a third axis 3*a*, as well as a striker 6, catch hook 5 being assigned to rotary latch 4. Retaining pawl 2 and rotary latch 4 are supported in a lock cover of a motor vehicle. Striker 6 is positioned on the front hood of the motor vehicle such that, when the front hood is in the closed position, the rotary latch is operatively connected to striker 6 and is retained by retaining pawl 2. Striker 6 is substantially U-shaped, and has a middle limb 10. Rotary latch 4 is fork-shaped, and has a recess 8 which is adapted to the contour of middle limb 10. In the arrested state, recess 8 receives middle limb 10 of striker 6. In addition, rotary latch 4 has a stop 7 which, in the arrested state, engages with an integral formation 9 in the form of a tooth segment of retaining pawl 2. In this arrested position, rotary latch 4 securely accommodates middle limb 10 of striker 6 in its recess 8. This state is not shown in FIG. 1.

Catch hook 5 is connected to a return spring 16; at a free end 12, catch hook 5 has a hook part 13 that assumes a safety function. When the locking of the front hood is released, hook part 13 receives middle limb 10 of striker 6. Catch hook 5 is preloaded via return spring 16 into the arresting position, so that upon release of the arresting, middle limb 10 is initially hindered by hook part 13 on its opening path toward a complete opening. The opening of the front hood is only able to be continued because the spring energy of return spring 16 is overcome.

Retaining pawl 2 is operable manually via a Bowden cable or electromotively. The release of the arresting state is triggered by actuation of the Bowden cable or the electromotive drive. Due to the triggering, integral formation 9 of retaining pawl 2 is pulled away from stop 7 of rotary latch 4, whereby rotary latch 4, preloaded by a spring 15, rotates about second axis 3, and catch hook 5, preloaded by spring 16, likewise swivels about third axis 3*a*, taking along middle limb 10 of striker 6 in its hook part 13, and stops in an intermediate position as a function of the spring energy of return spring 16.

An ejector spring 14 acts on striker 6 to be opened, and after actuation of the Bowden cable or the electromotive drive, pushes it upward.

Third axis 3*a* of catch hook 5 extends parallel to second axis of rotation 3 of rotary latch 4, and catch hook 5 is able to swivel about third axis 3*a* assigned to it, independently of rotary latch 4.

The second axis of rotation 3 of rotary latch 4 and third axis 3*a* of catch hook 5 coincide and agree.

LIST OF REFERENCE CHARACTERS

1 Axis of rotation of the retaining pawl
2 Retaining pawl
3 Axis of rotation of the rotary latch
3*a* Axis of rotation of the catch hook
4 Rotary latch
5 Catch hook
6 Striker vertical
6*a* Striker swiveled
7 Stop/locking area of rotary latch
8 Recess for striker
9 Integral formation/locking area of retaining pawl
10 Middle limb
11 Lower side of hook
12 Lower edge of hook
13 Hook
14 Elastic spring element/ejector spring
15 Return spring rotary latch
16 Return spring catch hook
17 Outer contour of the hook
18 End of the hook
19 Outer contour of the middle limb

What is claimed is:

1. A safety closure system for a front hood of a motor vehicle, comprising:

a catch hook swivelable about a catch hook axis;

a substantially U-shaped striker located on the front hood and having a middle limb;

a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive;

wherein the rotary latch is adapted to receive the middle limb of the substantially U-shaped striker to operatively connect to the striker in a closed position of the front hood;

wherein the catch hook is adapted to operatively connect to the striker upon release of retention of the front hood by the rotary latch to perform a safety function; and wherein the catch hook is swivelable, independently of the rotary latch, about the catch hook axis, the catch hook axis being coincident with the rotary latch axis.

2. The safety closure system according to claim 1, wherein the catch hook is operatively connected to a return spring.

3. The safety closure system according to claim 1, wherein an outer contour of a hook of the catch hook at a right angle to the axis catch hook axis has a slope in a direction of an end of the hook.

4. The safety closure system according to claim 3, wherein the slope of the outer contour of the hook of the catch hook increases at the end of the hook.

5. The safety closure system according to claim 1, wherein an outer contour of a hook of the catch hook is convexly curved.

6. The safety closure system according to claim 1, wherein a lower side of a hook of the catch hook is at least partially complementary to an outer contour of the middle limb of the striker so that the middle limb of the striker is accommodatable securely by the hook of the catch hook.

7. A safety closure system for a front hood of a motor vehicle, the front hood including a substantially U-shaped striker having a middle limb, comprising:

a catch hook swivelable about a catch hook axis;

a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive;

wherein the rotary latch is adapted to receive the middle limb of the substantially U-shaped striker to operatively connect to the striker in a closed position of the front hood;

wherein the catch hook is adapted to operatively connect to the striker upon release of retention of the front hood by the rotary latch to perform a safety function; and wherein the catch hook is swivelable, independently of the rotary latch, about the catch hook axis, the catch hook axis being coincident with the rotary latch axis.

8. A motor vehicle, comprising:

a front hood including a substantially U-shaped striker having a middle limb; and a safety closure for the front hood, the safety closure including:

a catch hook swivelable about a catch hook axis;

a rotary latch swivelable about a rotary latch axis and having a fork-shaped recess adapted to a shape of the striker; and a retaining pawl swivelable about a retaining pawl axis and operable by at least one of (a) a Bowden cable and (b) an electromotive drive;

wherein the rotary latch is adapted to receive the middle limb of the substantially U-shaped striker to operatively connect to the striker in a closed position of the front hood;

wherein the catch hook is adapted to operatively connect to the striker upon release of retention of the front hood by the rotary latch to perform a safety function; and wherein the catch hook is swivelable, independently of the rotary latch, about the catch hook axis, the catch hook axis being coincident with the rotary latch axis.

* * * * *

UNITED STATES PATENT AND TRADEMARK OFFICE

CERTIFICATE OF CORRECTION

PATENT NO. : 8,534,720 B2
APPLICATION NO. : 12/863544
DATED : September 17, 2013
INVENTOR(S) : Meyer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 400 days.

Signed and Sealed this
Fifteenth Day of September, 2015

Michelle K. Lee

Michelle K. Lee
*Director of the United States Patent and Trademark Office*